US005906187A

United States Patent [19]

Heuer

[11] Patent Number: 5,906,187

[45] Date of Patent: May 25, 1999

[54] METHOD FOR ADJUSTING THE FUEL INJECTION QUANTITY OF AN INTERNAL COMBUSTION ENGINE FOR REGULATING SMOOTH OPERATION

[75] Inventor: Karsten Heuer, Wasbüttel, Germany

[73] Assignee: Volkswagen AG, Wolfsburg, Germany

[21] Appl. No.: 09/090,758

[22] Filed: Jun. 4, 1998

[30] Foreign Application Priority Data

Jun. 14, 1997 [DE] Germany ..... 197 25 233

[51] Int. Cl.[6] ..... F02D 41/14

[52] U.S. Cl. ..... 123/436

[58] Field of Search ..... 123/434, 436, 123/435

[56] References Cited

U.S. PATENT DOCUMENTS

| | | | |
|---|---|---|---|
| 4,368,707 | 1/1983 | Leshner et al. | 123/436 |
| 4,616,617 | 10/1986 | Geiger et al. | 123/436 |
| 4,688,535 | 8/1987 | Küttner et al. | 123/436 |
| 5,056,487 | 10/1991 | Yamakado et al. | 123/436 |
| 5,101,791 | 4/1992 | Kuettner et al. | 123/436 |
| 5,144,927 | 9/1992 | Denz | 123/425 |
| 5,255,560 | 10/1993 | Klenk et al. | 73/116 |
| 5,263,365 | 11/1993 | Müller et al. | 73/117.3 |
| 5,339,781 | 8/1994 | Osawa | 123/357 |
| 5,485,374 | 1/1996 | Takaku et al. | 364/424.03 |
| 5,587,524 | 12/1996 | Hampo et al. | 123/436 |
| 5,747,679 | 5/1998 | Dietz et al. | 123/436 |
| 5,771,483 | 6/1998 | Moine et al. | 123/436 |
| 5,774,823 | 6/1998 | James et al. | 123/436 |

FOREIGN PATENT DOCUMENTS

| | | |
|---|---|---|
| 3604904 | 8/1987 | Germany . |
| 3705586 | 9/1988 | Germany . |
| 3942089 | 6/1991 | Germany . |
| 4138765 | 7/1992 | Germany . |
| 4319677 | 12/1994 | Germany . |
| 2256945 | 12/1992 | United Kingdom . |

*Primary Examiner*—Erick R. Solis
*Attorney, Agent, or Firm*—Baker & Botts, L.L.P.

[57] ABSTRACT

In the embodiment described in the specification, the fuel injection quantity for an internal combustion engine is adjusted for regulating smooth operation by recording a number of uneven operation fuel injection values for each individual cylinder during an observation interval, sorting the recorded uneven operation values individually for each cylinder operation according to their sign and magnitude, determining, individually for each cylinder, whether the median uneven operation value is lower than, equal to, or higher than zero, and increasing the injection quantity if the median uneven operation value is lower than zero, or reducing the fuel injection quantity if the median uneven operation value is higher than zero.

4 Claims, 1 Drawing Sheet

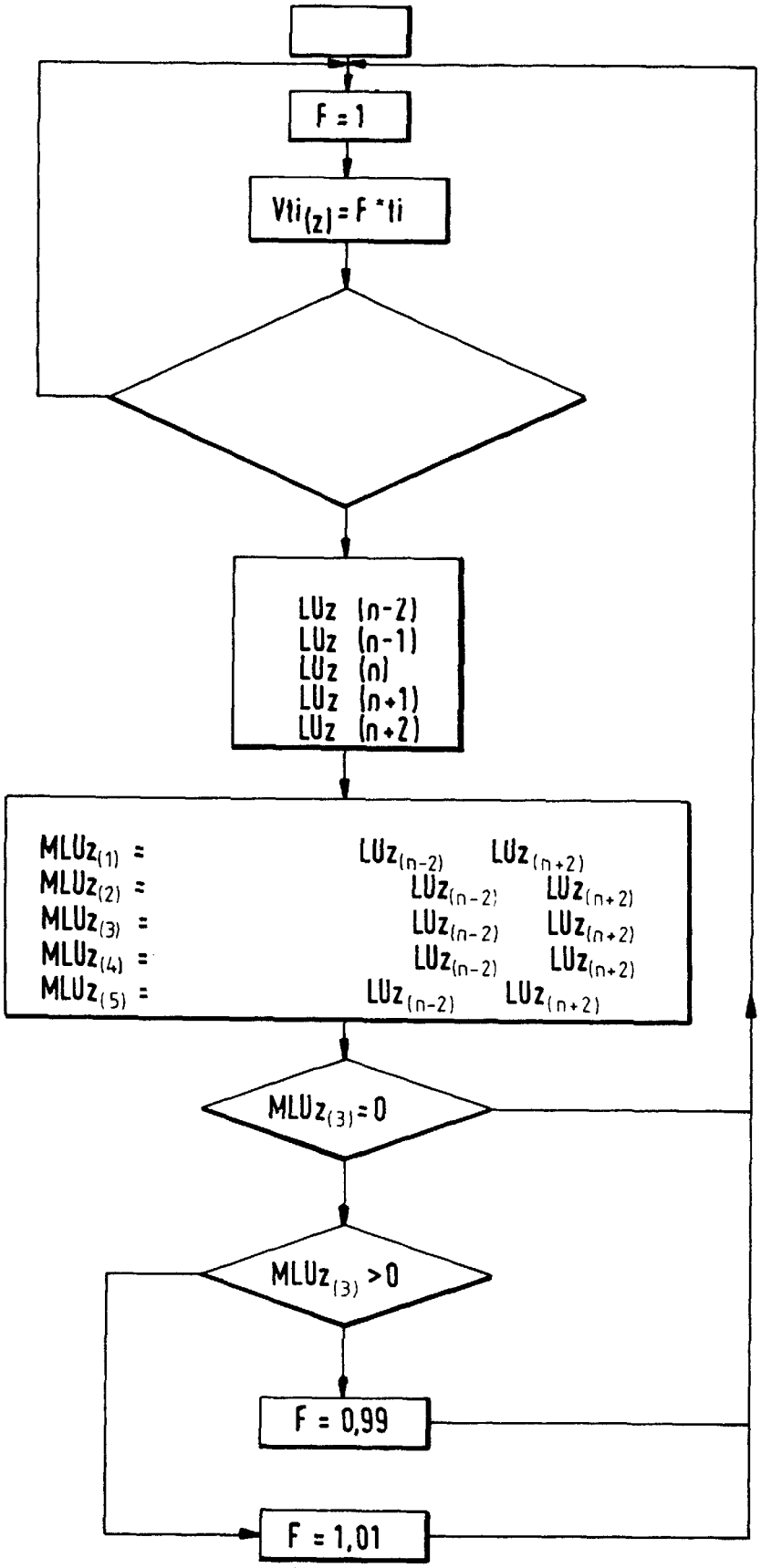
F = 1
Vti(z) = F * Ti
LUz (n-2)
LUz (n-1)
LUz (n)
LUz (n+1)
LUz (n+2)
MLUz(1) = LUz(n-2) LUz(n+2)
MLUz(2) = LUz(n-2) LUz(n+2)
MLUz(3) = LUz(n-2) LUz(n+2)
MLUz(4) = LUz(n-2) LUz(n+2)
MLUz(5) = LUz(n-2) LUz(n+2)
MLUz(3) = 0
MLUz(3) > 0
F = 0,99
F = 1,01

METHOD FOR ADJUSTING THE FUEL INJECTION QUANTITY OF AN INTERNAL COMBUSTION ENGINE FOR REGULATING SMOOTH OPERATION

BACKGROUND OF THE INVENTION

This invention relates to methods for adjusting the fuel injection quantity of an internal combustion engine for regulating smoothness of operation, especially for automobiles.

In automobiles, low frequency vibration of the entire vehicle often occurs in the lower speed range of the vehicle, in particular during idling. This vibration is often referred to as "shaking" and has a frequency in the range between 1 and 5 Hz.

The reason for this shaking is the range of tolerances required for mass production of fuel injection equipment. In this case, dimensional variations which can occur within the permitted tolerance ranges for the injection components give rise to fuel injection quantities which differ from cylinder to cylinder. These fuel quantity differences lead to rapid changes in torque which produce vibrations in the engine and body structure. Shaking is therefore an unavoidable consequence of manufacturing tolerances.

These low frequency vibrations can be damped, for example, by adjusting the fuel quantities injected into the individual cylinders. One arrangement for damping shaking comprises, for example, a controller which varies a predetermined desired fuel quantity value as a function of the rapid variations in torque in an attempt to make the torque variations as insignificant as possible.

U.S. Pat. No. 4,688,535 discloses an arrangement in which each cylinder has a control which forms a regulating fuel quantity value for that cylinder as a function of the actual fuel quantity value supplied to that cylinder and of an average of the fuel quantity value for all of the cylinders. Furthermore, in that arrangement the average value is formed from the preceding actual fuel quantity values of all of the cylinders. A disadvantage of that arrangement is the requirement for a complicated individual cylinder correction control which makes the arrangement complex and expensive.

German Patent No. 37 05 586 discloses an arrangement that generates fuel quantity signals which are dependent on the engine operating characteristics, determines from an engine speed signal a smooth running signal, derives from the smooth running signal a fuel quantity error per engine working stroke and cylinder, and superposes a corresponding correcting signal on the fuel quantity signal. The time period of the correcting signal corresponds to one camshaft revolution and the phase relationship of the corrective signal is oriented to the cylinder having the greatest fuel quantity deviation above the average value. In this case, therefore, the fuel quantity correction takes place uniformly for all cylinders.

German Offenlegungsschrift No. 43 19 677 discloses a method for regulating the smooth operation of an internal combustion engine in which a segmented wheel generates segment pulses, with two segment pulses defining each segment, and each cylinder of the internal combustion engine is assigned an actual smooth operating fuel quantity value, a desired smooth operating fuel quantity value, a control deviation, and a controller. Each controller predetermines a cylinder-specific regulating fuel quantity value, starting from the associated control deviation, and the actual smooth operating fuel quantity value and desired smooth operating fuel quantity value are predetermined, starting from at least one segment period duration, the actual smooth operation values and/or the control deviations supplied to the controllers being predetermined by using a weighted average value.

One disadvantage of the conventional methods is that they readjust the fuel quantity for each cylinder on the basis of individual deviations with the result that the overall behavior of the internal combustion engine is uneven. This is particularly true in the case of singular deviations or periodically occurring fluctuations of individual combustions resulting from deposits on the injection valves.

SUMMARY OF THE INVENTION

Accordingly, it is an object of the present invention to provide a method for adjusting the fuel injection quantities of an internal combustion engine to regulate smooth operation which overcomes disadvantages of the prior art.

Another object of the invention is to provide a method for adjusting the fuel injection quantities of an internal combustion engine to regulate smooth operation which leads to a smoother overall behavior.

These and other objects of the invention are attained by recording a number of uneven running values from an individual cylinder during an observation interval, with singular deviations being ignored, and setting the median of those values at zero. This results in a smoother overall behavior in the internal combustion engine.

BRIEF DESCRIPTION OF THE DRAWING

Further objects and advantages of the invention will be apparent from a reading of the following description in conjunction with the accompanying drawing which is a schematic flow diagram illustrating a representative embodiment of the method of the invention.

DESCRIPTION OF PREFERRED EMBODIMENT

In the typical embodiment of the invention shown in the drawing, at the start of the method each cylinder has a fixed fuel injection time (i.e. duration) $Vti_{(Z)}=F*ti$, in which F=1. As long as an uneven operation calculation is not active and a segmented transmitter wheel generating an adjustment signal has not responded, there is no change to the fuel injection times for the cylinders. By contrast, if there are both an active uneven operation calculation and a signal from the transmitter wheel and the engine is idling, five uneven operation values $LU_{Z(n\cdot 2)}$ to $LU_{Z(n+2)}$ for each individual cylinder during one observation interval are recorded and are filed, for example, in a storage drum. The recorded uneven operations values $LU_{Z(n\cdot 2)}$ to $LU_{Z(N+2)}$ can be positive when a subsequent fuel combustion is more rapid than a preceding fuel combustion, or can be negative when the subsequent combustion is slower than the preceding combustion. If the two successive fuel combustions for a cylinder are completed in the same time, the operation for that cylinder during that cycle is not uneven and the "uneven operation" value is therefore zero.

The recorded values $LU_{Z(n\cdot 2)}$ to $LU_{Z(n+2)}$ for each interval are ordered according to their sign and magnitude and any conventional sorting algorithm can be used for this purpose. The median value $MLU_{Z(3)}$ according to magnitude sorting is checked to determine whether it is zero. If $MLU_{Z(3)}$ is equal to zero, the fuel injection time Vti remains unchanged. By contrast, if $MLU_{Z(3)}$ is higher than zero, the factorial starting value F is reduced from 1 to 0.99. According to the relation Vti=F*ti, therefore, the fuel injection time Vti, and consequently the fuel injection quantity supplied to the cylinder are lowered. Similarly, the fuel injection time Vti and therefore the injection quantity are raised if $MLU_{Z(3)}$ is lower than zero, so that, in each case, the median uneven operation value $MLU_{Z(3)}$ is set to zero. This setting operation takes place in parallel for each cylinder.

Although the invention has been described herein with reference to a specific embodiment, many modifications and variations therein will readily occur to those skilled in the art. Accordingly, all such variations and modifications are included within the intended scope of the invention.

I claim:

1. A method for adjusting the injection quantity of fuel in an internal combustion engine for regulating smooth operation comprising the following method steps:

(a) for each individual engine cylinder, recording a number of uneven operation smoothness values from the cylinder during an observation interval;

(b) sorting the recorded uneven operation smoothness values individually for each cylinder according to their recorded magnitude;

(c) determining, individually for each cylinder, whether the median uneven operation smoothness value according to the sorting is lower than, equal to, or higher than zero; and (d) increasing the fuel injection quantity individually for each cylinder if the median uneven operation smoothness value is lower than zero, or reducing the fuel injection quantity if the median uneven operation value is higher than zero.

2. A method according to claim 1 wherein the fuel injection quantity is increased or reduced in fixed adjustable units.

3. A method according to claim 1 wherein at least five uneven running operation values are recorded during the observation interval.

4. A method according to claim 1 wherein the fuel injection quantity is adjusted by varying the fuel injection time.

* * * * *